United States Patent [19]

Gabriel

[11] Patent Number: 4,630,620

[45] Date of Patent: Dec. 23, 1986

[54] CIGARETTE WITH CONDENSING SURFACE THEREIN

[76] Inventor: Naeem B. Gabriel, 2 Kingsbury Sq., Apt. #19E, Trenton, N.J. 08611

[21] Appl. No.: 230,360

[22] Filed: Jan. 30, 1981

Related U.S. Application Data

[63] Continuation of Ser. No. 931,102, Aug. 25, 1978, abandoned.

[51] Int. Cl.[4] ..... A24D 1/00

[52] U.S. Cl. ..... 131/331; 131/344; 131/364

[58] Field of Search ..... 131/331, 360, 363, 364, 131/365, 344

[56] References Cited

U.S. PATENT DOCUMENTS

| | | | |
|---|---|---|---|
| 2,976,190 | 3/1961 | Meyer | 131/331 |
| 3,370,593 | 2/1968 | Owaki | 131/365 |
| 3,409,021 | 11/1968 | Owaki | 131/365 |

*Primary Examiner*—Vincent Millin

[57] ABSTRACT

A cigarette having a plurality of thin flat discs aligned along the central axis of the cigarette wherein the surfaces of the disc condense the tobacco smoke therein.

2 Claims, 6 Drawing Figures

CIGARETTE WITH CONDENSING SURFACE THEREIN

CROSS-REFERENCE TO RELATED APPLICATIONS

This is a continuation application to the parent application Ser. No. 05/931,102, which was filed 8-25-1978 now abandoned.

BACKGROUND OF THE INVENTION (1) Field of the invention

It relates to cigarettes, and more specifically to a novel method wherein the amount of tar, nicotine, and some other compounds resulting from the burning of a cigarette; are reduced to a minimum by their condensation on a relatively colder metallic surface, before inhalation of the smoke.

(2) Description of the prior art

There are a number of some former inventions which dealt with the subject of cleaning the smoke of the cigarette before inhalation. Some of them introduced tobacco which was treated chemically; whereas the others used chemically treated paper wrapper.

For example: in U.S. Pat. No. 3106210 by Reynolds; he included in his cigarette: activated alumina, bauxite, gum, and some bulky material dyed with either ferric ammonium oxalate or mono-azo dyestuff; such bulky materials may be sorbitol or carboxy methyl cellulose.

Also in that same invention, Reynolds suggested using paper wrapper electroplated with a metallic surface, or which incorporated metallic powder inside the paper wrapper. Evidently in both his two developments; the first one with all these additives and chemicals smoke hazard increased; and in the later one the amount of carbon monoxide increased because there was not enough oxygen being provided for the burning.

In U.S. Pat. No. 3046996 by Schur, and No. 439004 by Harris, also the French Pat. No. 998557 and the two Belgium Pat. No. 568149 and No. 570440 all of them offered a perforated paper wrapper; which was not a bad idea, but compared to my novel method they did not provide that cold surface which helps in cleaning the smoke.

In U.S. Pat. No. 3370593 and No. 3409021 by Owaki in which he used metallic strips or bands adhered to the paper wrapper; it appears that his methods have their disadvantages: for using glue, in not providing a relatively big heat dissipating surface, and do not provide good ventillation to the cigarette, and in my opinion he could have done a better job if the strips or the bands were perforated; but the method taught the opposite. In a restriction Owaki claimed that the metallic bands must be three times as wide as the intervening bands of paper, and in doing so the ventillation of the cigarette turned to be bad.

SUMMARY OF THE NEW EMBODIMENT

The new embodiment which I submit here takes in account all the weak points mentioned before in the prior art. My method provides good ventillation and also provides a relatively cold surface for the condensation of most of the nicotine, the tar and some other undesirable compounds in the smoke.

In one of my new methods that I offered here, I used some small aluminum discs stacked one over the other to form a column. That column of the stack of the small aluminum discs is put in the middle of the tobacco on the longitudinal axle of the cigarette.

In another method, I used a wide strip of aluminum foil to put it amidst the tobacco as a sector; to divide it into two parts along the length of the cigarette. That strip may be folded as a zigzag, or may be sectioned into little strips which overlaps one on the other.

In a third method I used a number of small pellets of uneven shapes. These pellets are cut from crushed or wrinkled aluminum foil, and they may be arranged one over the other to form a column in the middle of the tobacco along the axle of the cigarette. Or these pellets may be scattered in the tobacco.

Each one of the afore mentioned methods does not only provide for cleaning the smoke as it was explained before; but it is also economic and comparatively healthier. The quantity of the tobacco comes less if the size of the cigarette does not change, and the aroma of the tobacco stays natural. Add to that; the discarding of the ashes will not be a problem. Finally, the method of including the pellets might have an application in medication.

BRIEF DESCRIPTION OF THE DRAWINGS

FIG. (1) is a cross-section in a cigarette in its novel construction. In FIG. (1) the paper wrapper is I-II, and I-13 is a plurality of aluminum discs stacked one over the other to form a column. That column of these aluminum discs is positioned on the longitudinal axle of the cigarette in the middle of the tobacco 1-12.

FIG. (2) shows three constructions:

FIG. 2-*b* shows a cross-section in a cigarette where 2-*b* is a strip of aluminum foil which is folded as a zigzag.

FIG. 2-*c* shows a cross-section in a cigarette where 2-*c* is a strip of aluminum foil sectioned to smaller parts, and these sections overlap one over the other; parallel to the width of that cigarette.

DESCRIPTION OF THE PREFERRED EMBODIMENT

To minimize the amount of tar and nicotine being inhaled while smoking a cigarette, I offer here some novel methods for the purpose of achieving that. Mainly these methods move around the idea that a light metallic surface such as aluminum foil when it is found amidst the tobacco in the cigarette; provides a cold surface on which tar and nicotine tends to condense upon.

That aluminum foil will not interfere with the regular burning of the tobacco, if the thickness of that foil is similar to that one being used in the kitchen; and also if enough ventillation is provided for the burning of the tobacco.

In FIG. (1) I used a stack of small and fine metallic discs taken from aluminum foil, then that stack of fine metallic discs 1-13 was put admist the tobacco 1-12 of the cigarette where 1-11 is its paper wrapper. The metallic discs are stacked one over the other to form a column. That column takes its place on the longitudinal axle of the cigarette. The diameter of each disc is about one quarter of that of the cigarette. When the cigarette is lighted; the metal will not interfere with the regular burning of the tobacco, and in the same time will provide a colder surface on which nicotine and tar in the smoke tend to condense. Discarding the ashes will be easy since the discs are loose and not adhered to one another.

Figure 1:
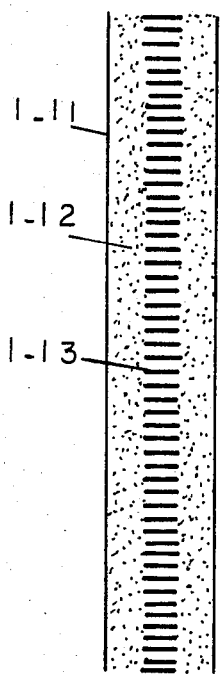
Figure 2:
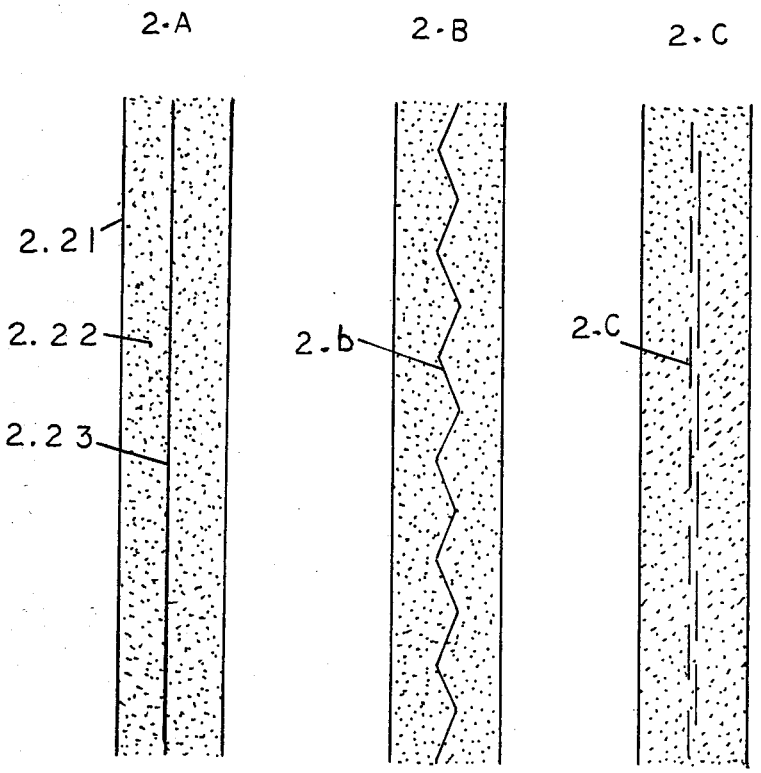
FIG. 2-*a* shows a cross-section in a cigarette where 2-21 is its paper wrapper, and 2-23 is a atrip of aluminum foil which splits the tobacco 2-22 in that cigarette into two parts.

The second method which I offered is shown in FIG. 2 with its **2-*a* , 2-*b* , and 2-*c*** in the drawing.

FIG. **2-*a* is a newly developed cigarette where in it the paper wrapper is 2-21, and 2-22 is the tobacco which fills it, and amidst the tobacco I put a wide and long strip of aluminum foil 2-23** which makes a partition Since it separates the tobacco inside that cigarette into two parts all along its length.

When that cigarette is lighted said strip of aluminum foil will allow the tobacco on both sides to burn as usual, and this wide and cold surface will help the condensation of most of the tar and the nicotine on it. Said partition or that strip of aluminum foil may be folded like a zigzag as it is shown in FIG. **2-*b*. In that manner the surface area of that partition increases, and constitutes more resistance to the flow of the smoke. Also that partition may be substituted by plurality of small sections, where one section overlaps on another section as in FIG. 2-*c***. In this method discarding of the ashes is easier.

Figure 3:
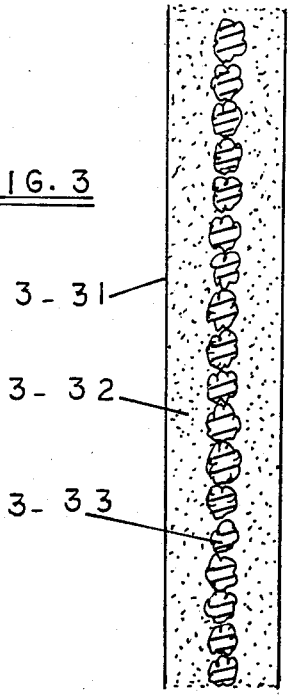
FIG. 3 is a cross-section in a cigarette where 3-31 is the paper wrapper and 3-33 are small pellets of crushed or wrinkled aluminum foil. These pellets are arranged and stacked one over the other as a column on the longitudinal axle of that cigarette, in the middle of the tobacco 3-32 in it. These pellets are porous.

In another new development as it is shown in FIG. 3; I put some small pellets 3-33 cut from crushed aluminum foil in the middle of the tobacco 3-32. The paper wrapper is 3-31.

Said pellets 3-33 are arranged one over the other to form a column in the midst of the tobacco.

The pellets 3-33 are unshapely, have many grooves in them, and their radius is about one fourth of the radius of the cigarette.

When that cigarette is lighted, these pellets 3-33 will not interfere with the normal burning of the tobacco 3-32, and on the other hand tar and nicotine will find a place to condense in these grooves, or on that porous surface of said pellets.

Whereas in the development shown in FIG. 3 the small porous pellets were arranged one over the other as a column on the longitudinal axle of the cigarette; these porous pellets may be arranged differently.

Figure 4:
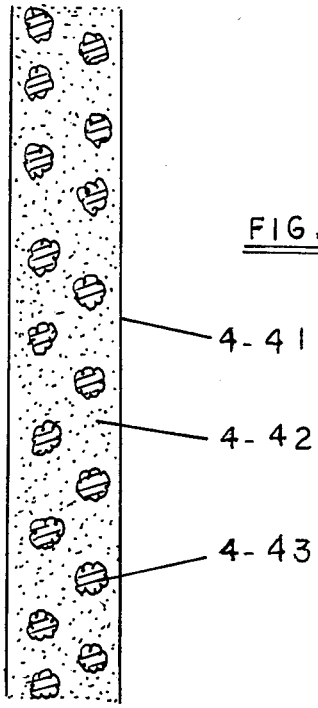
FIG. 4 is a cross section in a cigarette where 4-41 is its paper wrapper, and the tobacco in it is 4-42, and scattered in the tobacco are unshapely pellets of crushed or wrinkled aluminum foil 4-43, these pellets are porous.

In FIG. 4 these small porous pellets 4-43 may be scattered in the tobacco 4-42 of the cigarette. The paper wrapper is 4-41.

The pellets will not interfere with the burning of the tobacco, and also they will provide the same porous surface for the condensation of the tar and the nicotine on said porous pellets.

It is also clear that discarding of the ashes is easy in both these last two developments.

What I claim:

1. A cigarette comprising a paper wrapper surrounding a tobacco core, and a plurality of thin aluminum discs co-axially aligned along the central longitudinal axis of said tobacco core, said discs extend from one end of said core to the other end of said core.

2. A cigarette comprising a paper wrapper surrounding a tobacco core and a partition segregating the tobacco core into substantially two zones along the length of said core, said partition consists of a plurality of short segments wherein each segment forms an angle with its adjacent segment, said segments each being made out of aluminum.

* * * * *